US010801487B2

(12) United States Patent
Mou et al.

(10) Patent No.: US 10,801,487 B2
(45) Date of Patent: Oct. 13, 2020

(54) GAS TRANSPORTATION DEVICE

(71) Applicant: Microjet Technology Co., Ltd., Hsinchu (TW)

(72) Inventors: Hao-Jan Mou, Hsinchu (TW); Chun-Lung Tseng, Hsinchu (TW); Che-Wei Huang, Hsinchu (TW); Chien-Tang Wen, Hsinchu (TW); Shih-Chang Chen, Hsinchu (TW); Yung-Lung Han, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 196 days.

(21) Appl. No.: 16/052,955

(22) Filed: Aug. 2, 2018

(65) Prior Publication Data

US 2019/0060943 A1 Feb. 28, 2019

(30) Foreign Application Priority Data

Aug. 31, 2017 (TW) ..... 106129733 A

(51) Int. Cl.
*B05B 17/06* (2006.01)
*F04B 45/047* (2006.01)
*F04B 39/12* (2006.01)

(52) U.S. Cl.
CPC ..... *F04B 45/047* (2013.01); *B05B 17/0607* (2013.01); *F04B 39/121* (2013.01); *F04B 39/123* (2013.01)

(58) Field of Classification Search
CPC .... F04B 39/121; F04B 39/123; F04B 45/047; B05B 17/0607
See application file for complete search history.

(56) References Cited

U.S. PATENT DOCUMENTS

2011/0076170 A1* 3/2011 Fujisaki ..... F04B 45/047 417/415
2013/0071269 A1 3/2013 Fujisaki et al.
(Continued)

FOREIGN PATENT DOCUMENTS

CN 102046978 A 5/2011
CN 106030108 A 10/2016
(Continued)

OTHER PUBLICATIONS

Munson, Young, and Okiishi, "Fundamentals of Fluid Mechanics", 2006, John Wiley and Sons, Inc., 5th Edition, p. 438 (Year: 2006).*

*Primary Examiner* — Connor J Tremarche
(74) *Attorney, Agent, or Firm* — Birch, Stewart, Kolasch & Birch, Ltd.

(57) ABSTRACT

A gas transportation device includes a casing, a nozzle plate, a chamber frame, an actuator, an insulating frame and a conducting frame, which are stacked sequentially. The casing has a conduit protruding outwardly from the casing and aligned with a discharging opening. The conduit has a guiding channel and an outlet. The guiding channel has a cone shape and is tapered from an end proximate to the discharging opening to the other end proximate to the outlet. The actuator, the chamber frame and the suspension plate collaboratively define a resonance chamber. When the actuator is driven, the nozzle plate is subjected to resonance and the suspension plate of the nozzle plate vibrates in a reciprocating manner. Consequently, the gas is transported to a gas-guiding chamber through at least one gap and outputted from the discharging opening.

15 Claims, 8 Drawing Sheets

(56) References Cited

U.S. PATENT DOCUMENTS

| | | | | |
|---|---|---|---|---|
| 2014/0377099 | A1* | 12/2014 | Hsueh | F04B 43/046 417/413.2 |
| 2015/0071797 | A1* | 3/2015 | Takeuchi | F04B 43/0027 417/413.2 |

FOREIGN PATENT DOCUMENTS

| | | | |
|---|---|---|---|
| EP | 2 306 018 | A1 | 4/2011 |
| EP | 3 203 074 | A1 | 8/2017 |
| JP | 2011-27079 | A | 2/2011 |
| JP | 2013-151908 | A | 8/2013 |
| JP | 2014-88790 | A | 5/2014 |
| JP | 2016-211442 | A | 12/2016 |
| TW | M543870 | U | 6/2017 |
| WO | WO 00/28215 | A1 | 5/2000 |
| WO | WO 2009/025167 | A1 | 2/2009 |

* cited by examiner

GAS TRANSPORTATION DEVICE

FIELD OF THE INVENTION

The present disclosure relates to a gas transportation device, and more particularly to a miniature and silent gas transportation device for transporting gas at a high speed.

BACKGROUND OF THE INVENTION

Recently, in various fields such as pharmaceutical industries, computer techniques, printing industries or energy industries, the products are developed toward elaboration and miniaturization. The fluid transportation devices are important components that are used in, for example micro pumps, micro atomizers, print heads or industrial printers. Therefore, it is important to provide an improved structure of the fluid transportation device.

With the rapid development of technology, the applications of gas transportation devices are becoming more and more diversified. For example, gas transportation devices are gradually popular in industrial applications, biomedical applications, medical care applications, heat dissipation applications, or even the wearable devices. It is obvious that the trends of designing gas transportation devices are toward the miniature structure and the larger flow rate.

In accordance with the existing technologies, the gas transportation device is assembled by stacking a plurality of conventional mechanical parts. For achieving the miniature and slim benefits of the overall device, all mechanical parts are minimized or thinned. However, since the individual mechanical part is minimized, it is difficult to the control the size precision and the assembling precision. Consequently, the product yield is low and inconsistent, or even the flow rate of the gas is not stable. Moreover, as the conventional gas transportation device is employed, since the outputted gas fails to be effectively collected or the component size is very small, the force of transporting the gas is usually insufficient. In other words, the flow rate of the gas transportation is low.

Therefore, there is a need of providing a miniature gas transportation device applied in various devices to make the apparatus or equipment utilize the conventional gas transportation device to achieve small-size, miniature and silent benefits in order to eliminate the above drawbacks.

SUMMARY OF THE INVENTION

An object of the present disclosure provides a gas transportation device with special fluid channel and nozzle plate. The gas transportation device is small, miniature and silent, and has enhanced size precision.

Another object of the present disclosure provides a gas transportation device with a cuboidal resonance chamber and a special conduit. A Helmholtz resonance is produced by a piezoelectric plate and the cuboidal resonance chamber. Consequently, a great amount of gas is collected and transported at a high speed. The collected gas is in the ideal fluid state complying with the Bernoulli's principle. Consequently, the drawback of the prior art that the flow rate of the gas transportation is low is solved.

In accordance with an aspect of the present disclosure, a gas transportation device is provided for transporting gas. The gas transportation device includes a casing, a nozzle plate, a chamber frame, an actuator, an insulating frame and a conducting frame. The casing has at least one fixing recess, an accommodation recess and a discharging opening. The accommodation recess has a recess wall. The casing has a conduit protruding outwardly from the casing and aligned with the discharging opening. The conduit has a guiding channel and an outlet. The guiding channel is in communication with the accommodation recess through the discharging opening and in communication with the exterior of the casing through the outlet. The guiding channel has a cone shape and is tapered from an end proximate to the discharging opening to the other end proximate to the outlet. The nozzle plate has at least one bracket, a suspension plate and a through hole. The suspension plate is permitted to undergo a bending vibration. The at least one bracket is accommodated within the at least one fixing recess so as to positionally accommodate the nozzle plate within the accommodation recess. The nozzle plate and the recess wall of the accommodating recess collaboratively define a gas-guiding chamber. The gas-guiding chamber is in communication with the discharging opening. The at least one bracket, the suspension plate and the casing collaboratively define at least one gap. The chamber frame is stacked on the suspension plate, and the actuator is stacked on the chamber frame. In response to a voltage applied to the actuator, the actuator undergoes the bending vibration in a reciprocating manner. The insulating frame is stacked on the actuator, and the conducting frame is stacked on the insulating frame. The actuator, the chamber frame and the suspension plate collaboratively define a resonance chamber. When the actuator is driven, the nozzle plate is subjected to resonance, and the suspension plate of the nozzle plate vibrates in the reciprocating manner. Consequently, the gas is transported to the gas-guiding chamber through the at least one gap and discharged from the discharging opening to implement the gas transportation and circulation.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
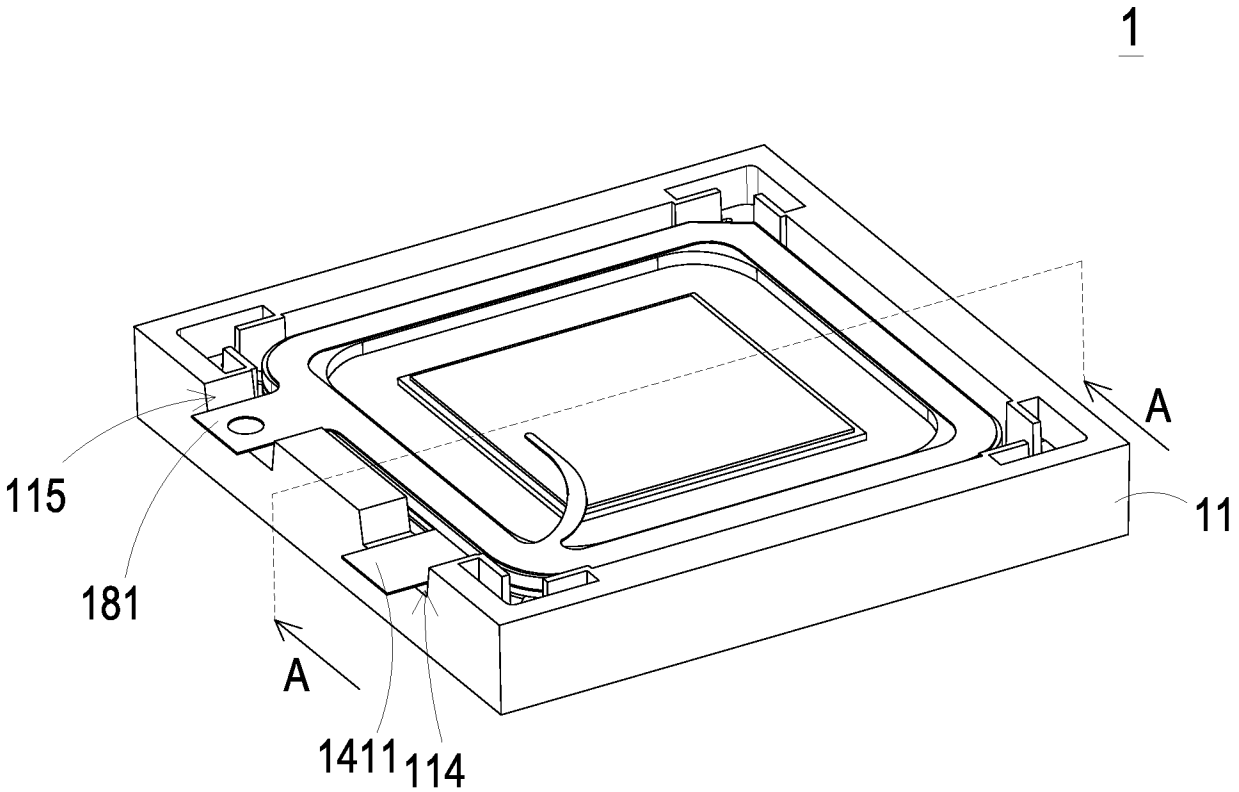
FIG. 1 is a schematic perspective view illustrating a gas transportation device according to some embodiments of the present disclosure.
Figure 2A:
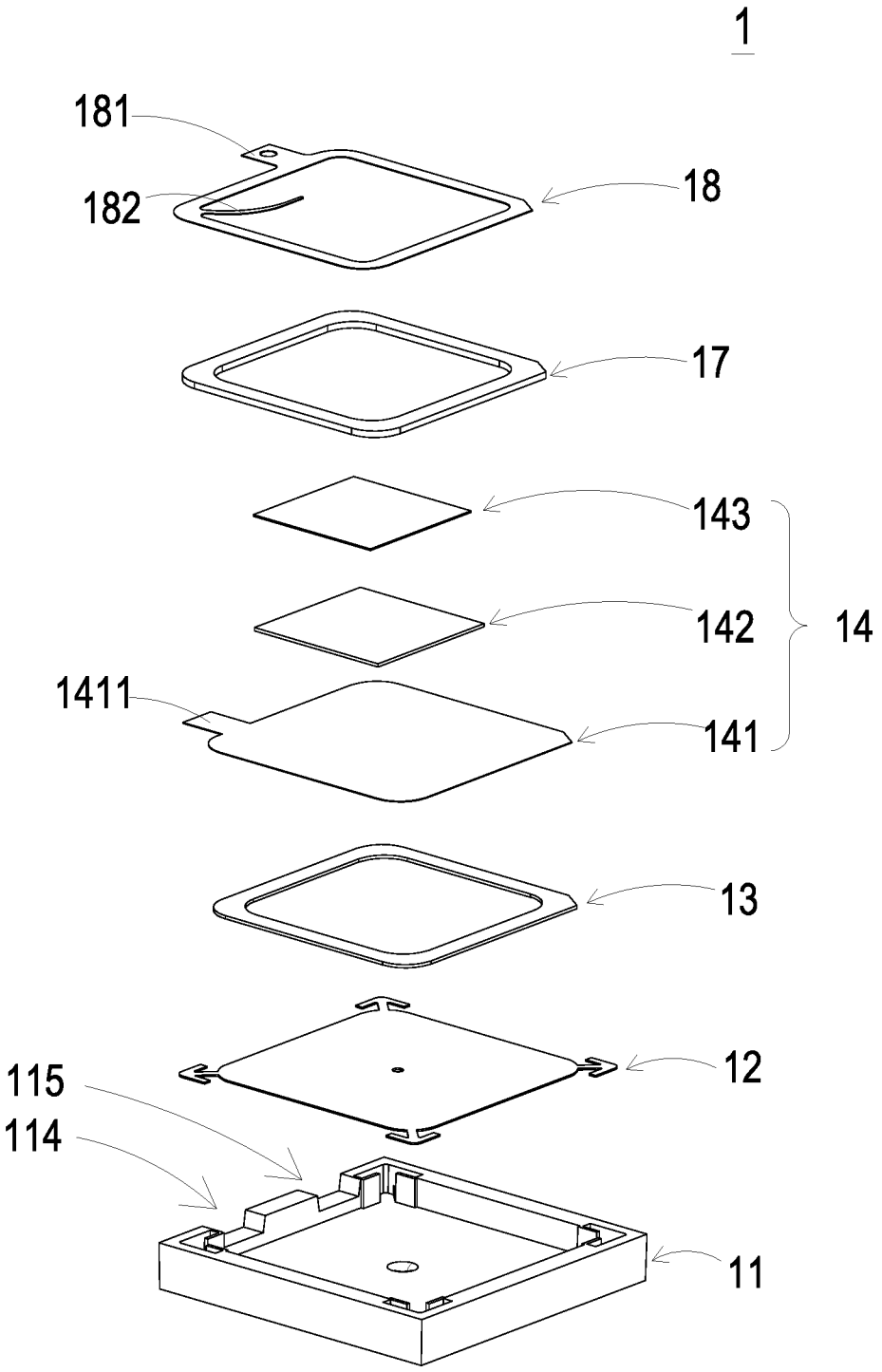
FIG. 2A is a schematic exploded view illustrating the gas transportation device according to some embodiments of the present disclosure.
Figure 2B:
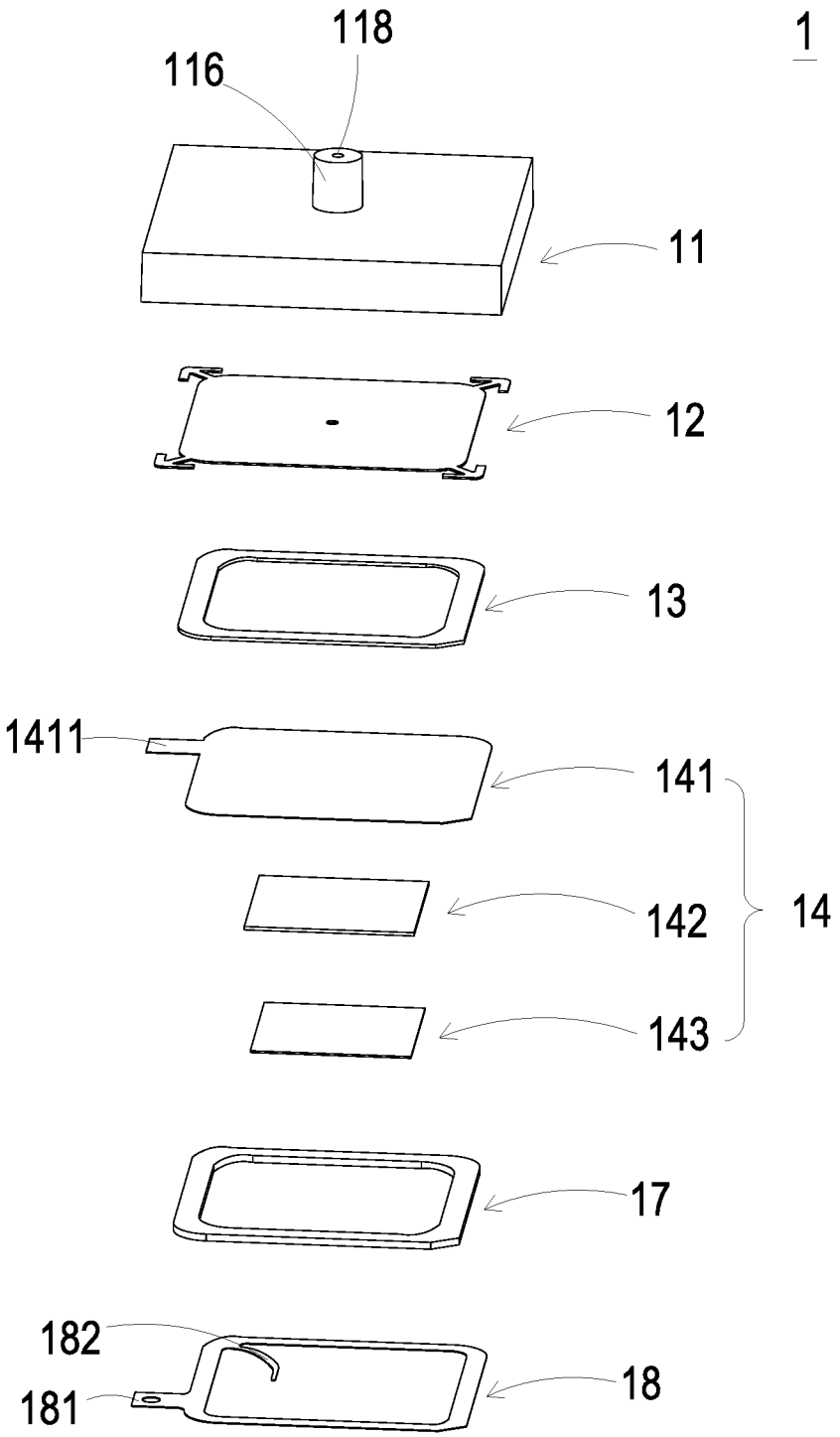
FIG. 2B is another schematic exploded view illustrating the gas transportation device according to some embodiments of the present disclosure.

FIG. 1 is a schematic perspective view illustrating a gas transportation device according to some embodiments of the present disclosure. FIG. 2A is a schematic exploded view illustrating the gas transportation device according to some embodiments of the present disclosure. FIG. 2B is another schematic exploded view illustrating the gas transportation device according to some embodiments of the present disclosure. Referring to FIGS. 1, 2A and 2B, the present discourse provides a gas transportation device 1 which has a miniature structure and is disposed for transporting gas at high speed and in large quantity. In some embodiments, the gas transportation device 1 includes at least one casing 11, at least one nozzle plate, at least one chamber frame 13, at least one actuator 14, at least one insulating frame 17 and at least one conducting frame 18. In some embodiments, the number of the at least one casing 11, the at least one nozzle plate 12, the at least one chamber frame 13, the at least one actuator 14, the at least one insulating frame 17 and the at least one conducting frame 18 is exemplified by one for each in the following embodiments but not limited thereto. In some embodiments, the casing 11, the nozzle plate 12, the chamber frame 13, the actuator 14, the insulating frame 17 and the conducting frame 18 are stacked on each other sequentially. It is noted that, in some other embodiments, the number of the at least one casing 11, the at least one nozzle plate 12, the at least one chamber frame 13, the at least one actuator 14, the at least one insulating frame 17 and the at least one conducting frame 18 can also be provided in plural numbers for each.

Figure 3:
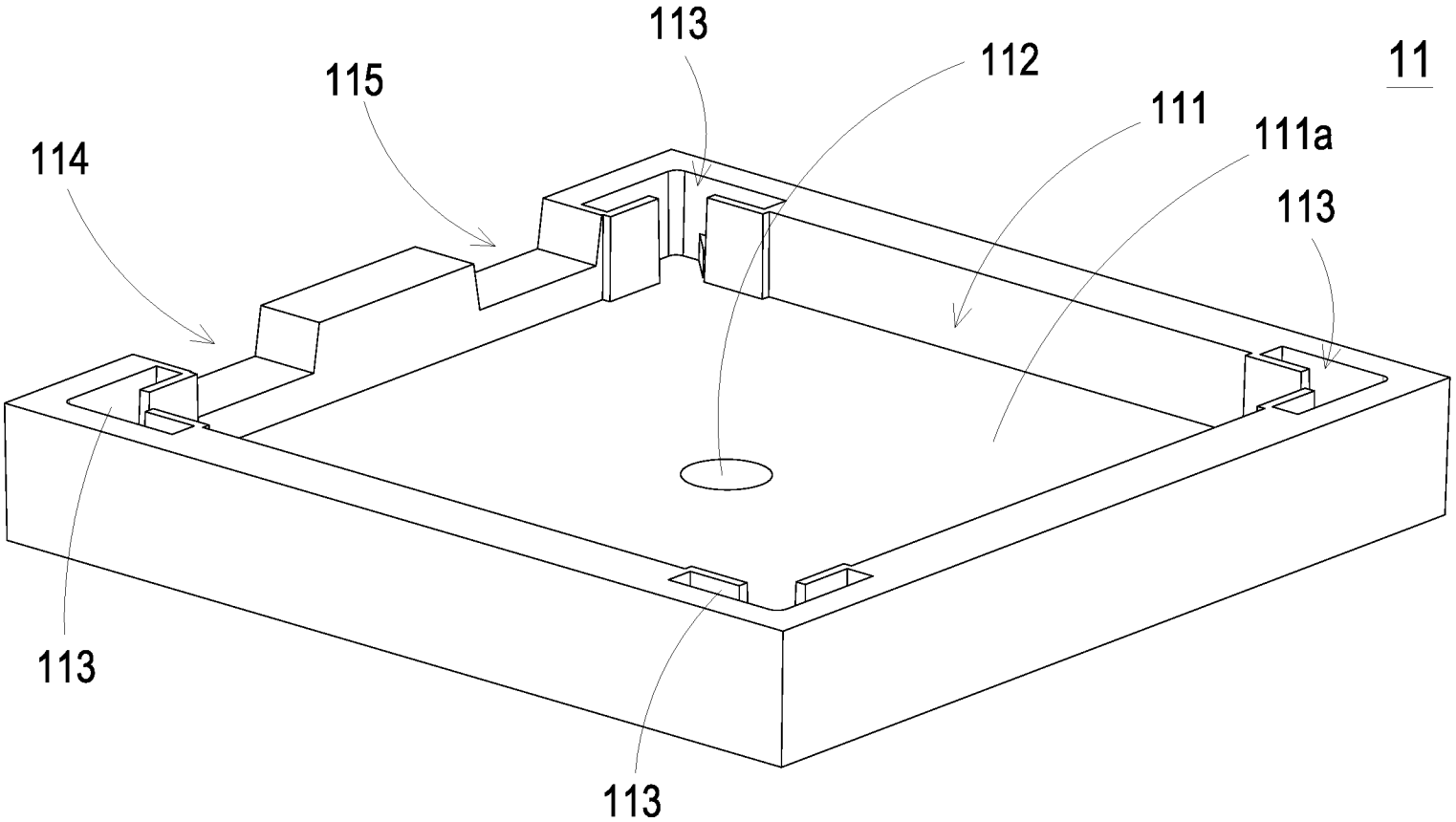
FIG. 3 is a schematic perspective view illustrating a casing of the gas transportation device.

FIG. 3 is a schematic perspective view illustrating a casing of the gas transportation device. Referring to FIGS. 2A, 2B and 3, in some embodiments, the casing 11 has an accommodation recess 111, a discharging opening 112, at least one fixing recess 113, a plate conducting pin opening 114, a frame conducting pin opening 115 and a conduit 116. The accommodation recess 111 has a recess wall 111*a*, and the accommodation recess 111 is a square recessed structure concavely formed in the interior of the casing 11. That is, the recess wall 111*a* of the accommodation recess 111 is square-shaped, but not limited thereto. In some other embodiments, the accommodation recess 111 may have a circular profile, an elliptic profile, a triangular profile or a polygonal profile. In some embodiments, the accommodation recess 111 is disposed for accommodating the nozzle plate 12, the chamber frame 13, the actuator 14, the insulating frame 17 and the conducting frame 18, which are stacked on each other. The discharging opening 112 extends through a central portion of the recess wall 111*a* for allowing the gas to flow therethrough. In some embodiments, the discharging opening 112 is in communication with the conduit 116. The at least one fixing recess 113 is disposed for fixing the nozzle plate 12 therein. In some embodiments, the casing 11 has four fixing recesses 113, which are located adjacent to four corners of the accommodation recess 111, respectively. Preferably but not exclusively, the fixing recesses 113 are arrow-shaped recesses. In some other embodiments, the number and shapes of the fixing recesses 113 are not restricted and can be varied according to the practical requirements. As shown in FIGS. 2B and 3, the conduit 116 is a hollow cylindrical structure. It is noted that, in some other embodiments, numerous modifications and alterations may be made while retaining the teachings of the disclosure. For example, the conduit 116 of the casing 11 may be omitted. That is, the gas may be directly discharged from the casing 11 through the discharging opening 112.

Figure 4:
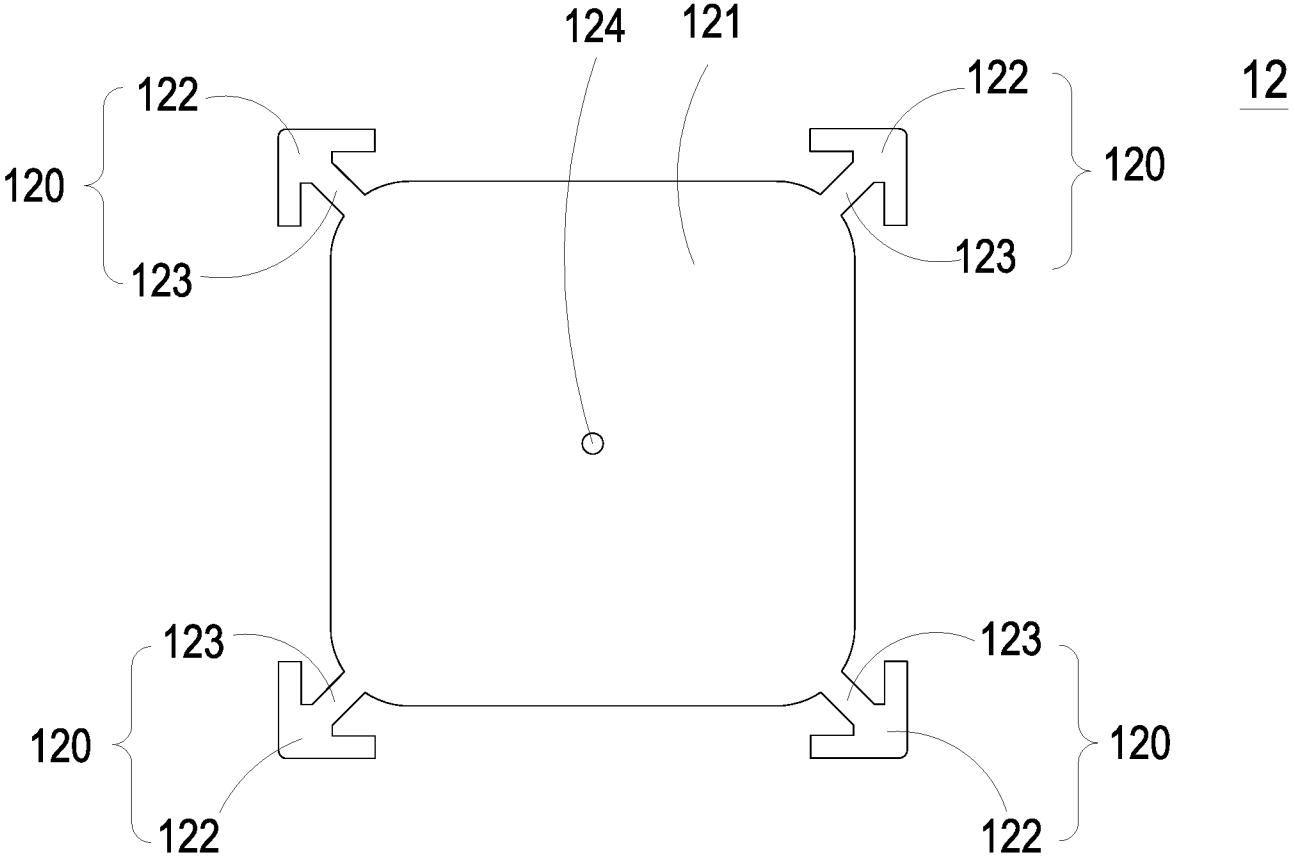
FIG. 4 is a schematic top view illustrating a nozzle plate of the gas transportation device.

FIG. 4 is a schematic top view illustrating a nozzle plate of the gas transportation device. Referring to FIGS. 2A, 2B and 4, in some embodiments, the nozzle plate 12 has at least one bracket 120, a suspension plate 121 and a through hole 124. The suspension plate 121 is a piece structure permitted to undergo bending vibration. The suspension plate 121 corresponds in shape to the accommodation recess 111, but not limited thereto. For example, the suspension plate 121 may have a square shape, a circular shape, an elliptic shape, a triangular shape or a polygonal shape. The through hole 124 extends through a central portion of the suspension plate 121 for allowing the gas to flow therethrough. In some embodiments, the nozzle plate 12 has four brackets 120, but not limited thereto. The number and type of the brackets 120 correspond to the number and type of the fixing recesses 113. In some other embodiments, the number and type of the brackets 120 may be varied according to the practical requirements. In some embodiments, each of the brackets 120 has a fixing part 122 and a connecting part 123. In some embodiments, the fixing part 122 of each of the brackets 120 corresponds in shape to a corresponding one of the fixing recesses 113. In some embodiments, the fixing parts 122 and the fixing recesses 113 are L-shaped. In such a manner, each of the fixing parts 122 can be positionally received in the corresponding one of the fixing recesses 113, and the connecting strength of each of the fixing parts 122 is also enhanced. Moreover, since each of the fixing parts 122 and the corresponding one of the fixing recesses 113 are engaged with each other, the nozzle plate 12 can be positioned in the accommodation recess 111 of the casing 11 more rapidly and precisely. Under this circumstance, the size precision of the gas transportation device is enhanced.

In some embodiments, for each of the brackets 120, the connecting part 123 is connected between the suspension plate 121 and the fixing part 122. Moreover, the connecting part 123 is elastic, so that the suspension plate 121 is permitted to undergo bending vibration in the reciprocating manner.

Figure 5A:
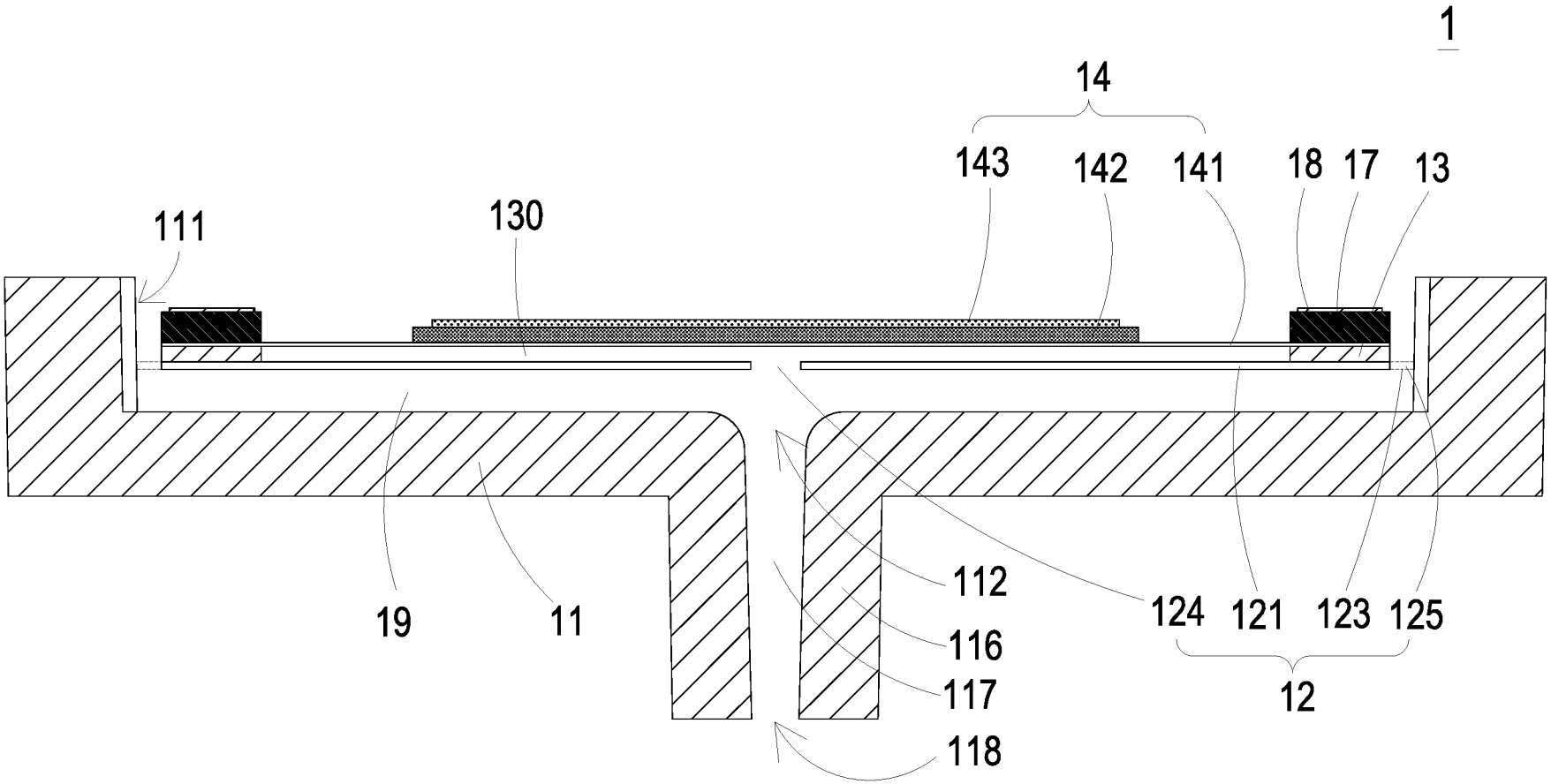
FIG. 5A is a schematic cross-sectional view illustrating the gas transportation device taken along line A-A in FIG. 1.

FIG. 5A is a schematic cross-sectional view illustrating the gas transportation device taken along line A-A in FIG. 1. Referring to FIGS. 2A, 2B and 5A, the conduit 116 has a guiding channel 117 and an outlet 118. The guiding channel 117 of the conduit 116 is in communication with the accommodation recess 111 through the discharging opening 112. The guiding channel 117 of the conduit 116 is in communication with the exterior of the casing 11 through the outlet 118. In some embodiments, a diameter of the discharging opening 112 is greater than a diameter of the outlet 118. In other words, a diameter of the guiding channel 117 is tapered from an end proximate to the discharging opening 112 to the other end proximate to the outlet 118. For example, the guiding channel 117 has a cone shape. The diameter of the discharging opening 112 is in the range between 0.85 millimeters and 1.25 millimeters. The diameter of the outlet 118 is in the range between 0.8 millimeters and 1.2 millimeters. When the gas is introduced into the conduit 116 from the discharging opening 112 and is discharged from the outlet 118, the gas is obviously converged in the guiding channel 117 so that a great amount of the converged gas is rapidly ejected out from the outlet 118 of the conduit 116.

In some embodiments, the brackets 120, the suspension plate 121 and the accommodation recess 111 of the casing 11 collaboratively define a plurality of gaps 125, so that the gas can be transported to a region between the accommodation recess 111 and the suspension plate 121 through the gaps 125.

The nozzle plate 12 the chamber frame 13 and the actuator 14 collaboratively define a resonance chamber 130. In some embodiments, the chamber frame 13 is a square frame structure, such that the resonance chamber 130 is a cuboidal resonance chamber for corresponding in shape to the chamber frame 13. A capacity of the resonance chamber 130 is in the range between 6.3 cubic millimeters and 186 cubic millimeters. Referring back to FIGS. 2A and 2B, the actuator 14 includes a carrier plate 141, an adjusting resonance plate 142 and a piezoelectric plate 143. In some embodiments, the carrier plate 141 is a metal plate. The carrier plate 141 has a plate conducting pin 1411 extending from a periphery of the carrier plate 141 for conducting electric power. The adjusting resonance plate 142 is attachedly stacked on the carrier plate 141. In some embodiments, the adjusting resonance plate 142 is also a metal plate. The piezoelectric plate 143 is stacked on the adjusting resonance plate 142. The adjusting resonance plate 142 is located between the piezoelectric plate 143 and the carrier plate 141, such that when the piezoelectric plate 143 is subjected to deformation in response to the electric power according to the piezoelectric effect, the adjusting resonance plate 142 is configured as a buffering element between the piezoelectric plate 143 and the carrier plate 141 for adjusting the vibration frequency of the carrier plate 141. A thickness of the adjusting resonance plate 142 is greater than that of the carrier plate 141. The vibration frequency of the actuator 14 is adjusted according to the thickness of the adjusting resonance plate 142. Consequently, the vibration frequency of the actuator 14 is controlled to be in the range between 10 KHz and 30 KHz. In some embodiments, a thickness of the carrier plate 141 is in the range between 0.04 millimeters and 0.06 millimeters. The thickness of the adjusting resonance plate 142 is in the range between 0.1 millimeters and 0.3 millimeters. The thickness of the piezoelectric plate 143 is in the range between 0.05 millimeters and 0.15 millimeters.

Referring to FIGS. 2A, 2B and 5A. The nozzle plate 12 is accommodated within the accommodation recess 111 of the casing 11. The nozzle plate 12 and the accommodation recess 111 collaboratively define a gas-guiding chamber 19 therebetween. The gas-guiding chamber 19 is in communication with the discharging opening 112. In some embodiments, a height of the gas-guiding chamber 19 is in the range between the 0.2 millimeters and 0.8 millimeters.

Referring to FIGS. 1, 2A, 2B and 3, the insulating frame 17 and the conducting frame 18 are disposed on the actuator 14. The conducting frame 18 has a frame conducting pin 181 and an electrode 182. The electrode 182 is electrically connected to the piezoelectric plate 143 of the actuator 14. The frame conducting pin 181 of the conducting frame 18 and the plate conducting pin 1411 of the carrier plate 141 respectively protrude outwardly from the frame conducting pin opening 115 and the plate conducting pin opening 114 of the casing 11 in order to be electrically connected to an external power source (not shown). Consequently, the carrier plate 141, the adjusting resonance plate 142, the piezoelectric plate 143 and the conducting frame 18 collaboratively form a loop. In addition, the insulating frame 17 is disposed between the conducting frame 18 and the carrier plate 141 so as to prevent the short-circuit problem caused by a direct electrically connection between the conducting frame 18 and the carrier plate 141.

Figure 5B:
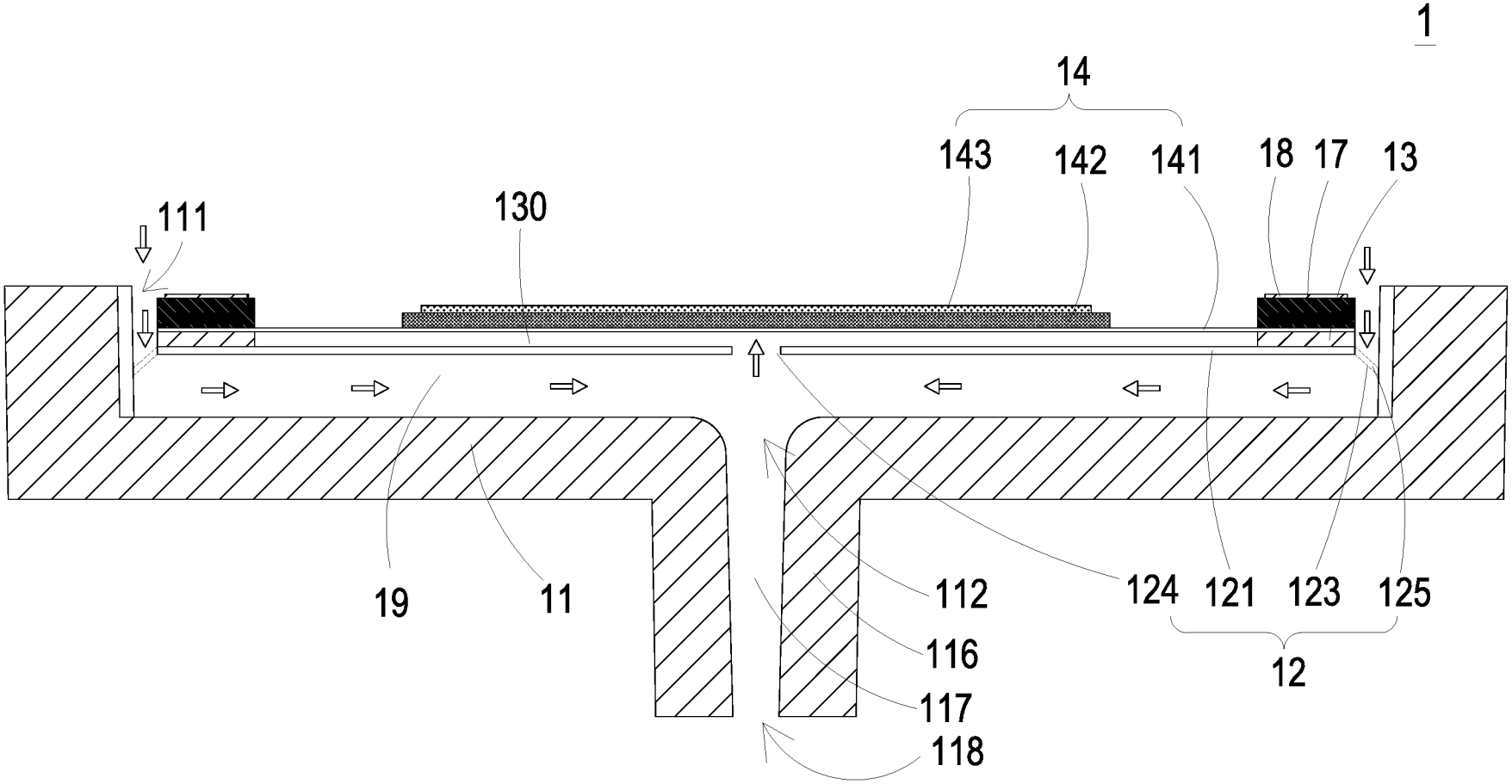
FIGS. 5B and 5C are schematic diagrams illustrating the actuations of the gas transportation device.
Figure 5C:
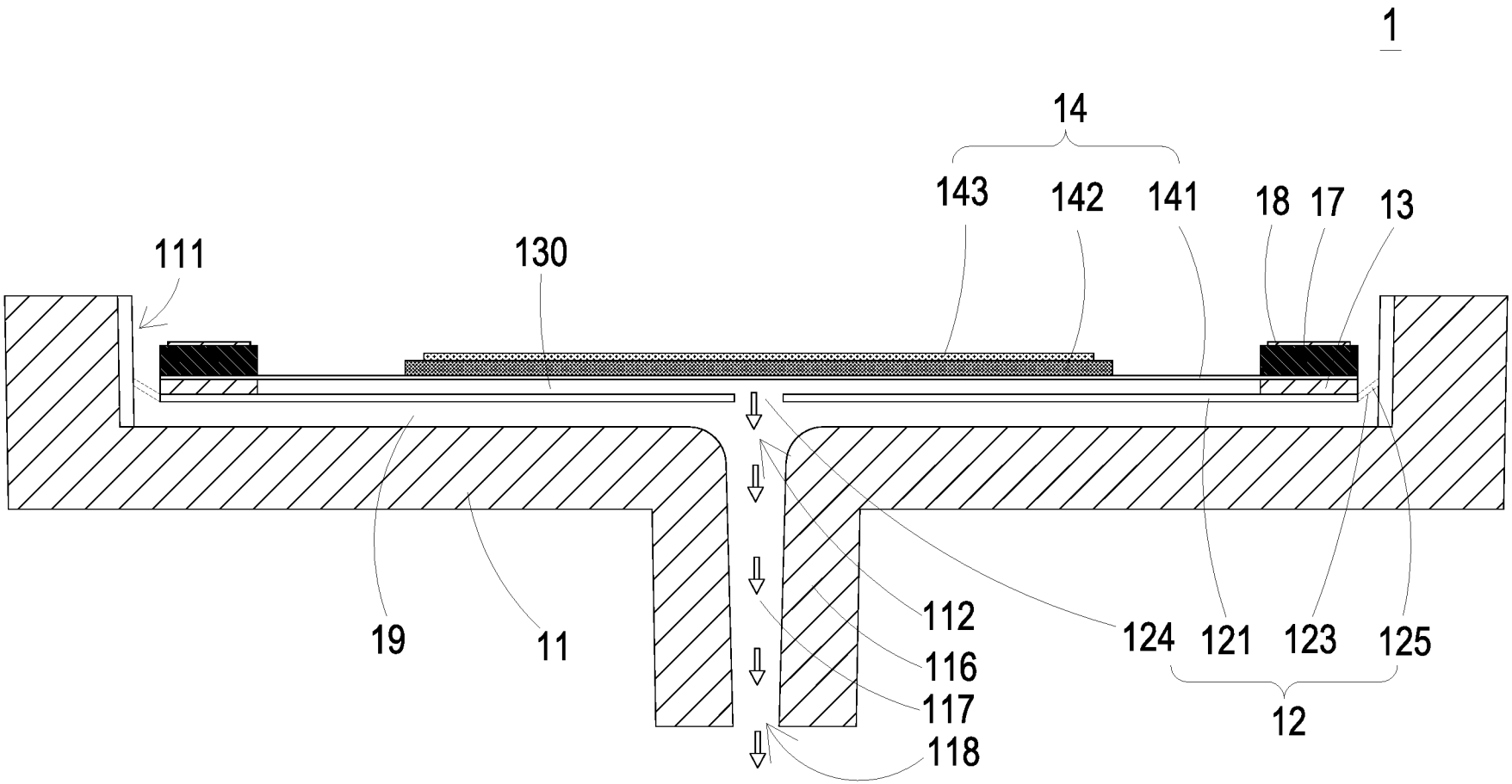

FIGS. 5B and 5C are schematic diagrams illustrating the actuations of the gas transportation device. As shown in FIG. 5A, the gas transportation device 1 is not driven and is in an initial state. In some embodiments, by controlling a gas vibration frequency of the cuboidal resonance chamber 130 to be close to the vibration frequency of the suspension plate 121, a Helmholtz resonance is produced by the cuboidal resonance chamber 130 and the suspension plate 121. Consequently, the gas transportation efficiency is enhanced. As shown in FIG. 5B, when the actuator 14 is driven and the piezoelectric plate 143 vibrates away from the recess wall 111*a* of the accommodation recess 111, the suspension plate 121 of the nozzle plate 12 also vibrates away from the recess wall 111*a* of the accommodation recess 111. Meanwhile, the gas is inhaled into the gas-guiding chamber 19 through the plurality of gaps 125, and the gas is then transported to the cuboidal resonance chamber 130 through the through hole 124. Consequently, the gas pressure in the cuboidal resonance chamber 130 is increased, and a pressure gradient is generated. As shown in FIG. 5C, when the piezoelectric plate 143 vibrates toward the recess wall 111*a* of the accommodation recess 111, the suspension plate 121 of the nozzle plate 12 also vibrates toward the recess wall 111*a* of the accommodation recess 111. Meanwhile, the gas flows out of the cuboidal resonance chamber 130 rapidly through the through hole 124 and compresses the gas in the gas-guiding chamber 19. Then, the gas is transported to the conduit 116, which is tapered from the end proximate to the discharging opening 112 to the other end proximate to the outlet 118, through the discharging opening 112 so as to converge the gas. Consequently, the great amount of the converged gas, which is in an ideal fluid state complying with the Bernoulli's principle, is rapidly ejected out from the outlet 118 of the conduit 116. According to the principle of inertial, after the gas is discharged, the gas pressure in the cuboidal resonance chamber 130 is lower than the atmospheric pressure. Consequently, the gas is introduced into the cuboidal resonance chamber 130 again. Therefore, through the vibration of the piezoelectric plate 143 in the reciprocating manner, and by controlling the gas vibration frequency of the cuboidal resonance chamber 130 to be substantially equal to the vibration frequency of the piezoelectric plate 143 to produce the Helmholtz resonance, the great amount of gas can be transported at a high speed.

From the above descriptions, the present disclosure provides the gas transportation device. When the voltage is applied to the piezoelectric plate, the piezoelectric plate vibrates in the reciprocating manner to drive the gas vibration of the cuboidal resonance chamber. Since the gas pressure in the cuboidal resonance chamber is subjected to a change, the purpose of the gas transportation is achieved. In addition, since each of the L-shaped connecting parts and the corresponding one of the L-shaped fixing recesses are engaged with each other, the nozzle plate can be easily and precisely positioned in the accommodation recess of the casing. That is, the gas transportation device of the present disclosure is miniature and has enhanced size precision. Since the contact area between the brackets and the casing is increased, the connecting capability of the brackets is enhanced. Moreover, since the gas vibration frequency of the cuboidal resonance chamber is substantially equal to the vibration frequency of the piezoelectric plate, the Helmholtz resonance is produced to transport the great amount of gas at the high speed. Therefore, the gas transportation speed and the quantity of the gas transportation are both enhanced. Furthermore, since the diameter of the guiding channel of the conduit is tapered from the end proximate to the discharging opening to the other end proximate to the outlet side, the gas is further converged. The converged gas, which is in the ideal fluid state complying with the Bernoulli's principle, is then rapidly ejected out. Consequently, the purpose of high speed gas transportation is achieved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A gas transportation device for transporting gas, comprising:

a casing having an accommodation recess and a discharging opening, wherein the accommodation recess has a recess wall, wherein the casing has a conduit protruding outwardly from the casing and aligned with the discharging opening, wherein the conduit has a guiding channel and an outlet, wherein the guiding channel is in communication with the accommodation recess through the discharging opening and in communication with the exterior of the casing through the outlet, and wherein the guiding channel has a cone shape and is tapered from an end proximate to the discharging opening to the other end proximate to the outlet;

a nozzle plate having a suspension plate and a through hole, wherein the suspension plate is permitted to undergo a bending vibration, wherein the nozzle plate is accommodated within the accommodation recess, wherein the nozzle plate and the recess wall of the accommodation recess collaboratively define a gas-guiding chamber, wherein the gas-guiding chamber is in communication with the discharging opening, and wherein the suspension plate and the casing collaboratively define at least one gap;

a chamber frame stacked on the suspension plate;

an actuator stacked on the chamber frame, wherein the actuator includes:

a carrier plate stacked on the chamber frame, wherein the carrier plate has a plate conducting pin;

an adjusting resonance plate stacked on the carrier plate; and a piezoelectric plate stacked on the adjusting resonance plate, and wherein when the voltage is applied to the piezoelectric plate, the carrier plate and the adjusting resonance plate undergo the bending vibration in the reciprocating manner;

an insulating frame stacked on the actuator; and a conducting frame stacked on the insulating frame, wherein the conducting frame has a frame conducting pin and an electrode, and the electrode is electrically connected to the piezoelectric late;

wherein the actuator, the chamber frame and the suspension plate collaboratively define a resonance chamber; and wherein when the actuator is driven, the nozzle plate is subjected to resonance, and the suspension plate of the nozzle plate vibrates in the reciprocating manner, so that the gas is transported to the gas-guiding chamber through the at least one gap and discharged from the discharging opening to implement the gas transportation and circulation.

2. The gas transportation device according to claim 1, wherein the accommodation recess has one of a square profile, a circular profile, an elliptic profile, a triangular profile and a polygonal profile.

3. The gas transportation device according to claim 1, wherein the suspension plate has one of a square profile, a circular profile, an elliptic profile, a triangular profile and a polygonal profile.

4. The gas transportation device according to claim 1, wherein a thickness of the adjusting resonance plate is greater than a thickness of the carrier plate.

5. The gas transportation device according to claim 1, wherein a thickness of the carrier plate is in a range between 0.04 millimeters and 0.06 millimeters.

6. The gas transportation device according to claim 1, wherein a thickness of the adjusting resonance plate is in a range between 0.1 millimeters and 0.3 millimeters.

7. The gas transportation device according to claim 1, wherein a thickness of the piezoelectric plate is in a range between 0.05 millimeters and 0.15 millimeters.

8. The gas transportation device according to claim 1, wherein the casing further has a plate conducting pin opening disposed for positioning the plate conducting pin of the carrier plate, and the plate conducting pin of the carrier plate protrudes outwardly from the plate conducting pin opening.

9. The gas transportation device according to claim 1, wherein the casing further has a frame conducting pin opening disposed for positioning the frame conducting pin, and wherein the frame conducting pin of the conducting frame protrudes outwardly from the frame conducting pin opening.

10. The gas transportation device according to claim 1, wherein a vibration frequency of the piezoelectric plate is in a range between 10 KHz and 30 KHz.

11. The gas transportation device according to claim 1, wherein a diameter of the discharging opening is in a range between 0.85 millimeters and 1.25 millimeters, and a diameter of the outlet is in a range between 0.8 millimeters and 1.2 millimeters.

12. The gas transportation device according to claim 1, wherein a height of the gas-guiding chamber is in a range between the 0.2 millimeters and 0.8 millimeters.

13. The gas transportation device according to claim 1, wherein a capacity of the resonance chamber is in a range between 6.3 cubic millimeters and 186 cubic millimeters.

14. The gas transportation device according to claim 1, wherein the casing has at least one fixing recess.

15. The gas transportation device according to claim 1, wherein the nozzle plate having at least one bracket, wherein the at least one bracket is accommodated within the at least fixing recess.

* * * * *